US009018828B2

(12) United States Patent
Tanaka et al.

(10) Patent No.: US 9,018,828 B2
(45) Date of Patent: Apr. 28, 2015

(54) LIGHT EMITTING ELEMENT LAMP AND LIGHTING EQUIPMENT

(71) Applicant: Toshiba Lighting & Technology Corporation, Yokosuka-shi, Kanagawa-ken (JP)

(72) Inventors: Toshiya Tanaka, Yokohama (JP); Shigeru Osawa, Yokohama (JP); Takeshi Hisayasu, Ota-ku (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 76 days.

(21) Appl. No.: 13/679,206

(22) Filed: Nov. 16, 2012

(65) Prior Publication Data

US 2013/0077310 A1 Mar. 28, 2013

Related U.S. Application Data

(63) Continuation of application No. 12/738,081, filed as application No. PCT/JP2008/068625 on Oct. 15, 2008, now Pat. No. 8,384,275.

(30) Foreign Application Priority Data

Oct. 16, 2007 (JP) ..... 2007-268769
Jul. 31, 2008 (JP) ..... 2008-198625

(51) Int. Cl.
*H01J 1/02* (2006.01)
*H01J 7/24* (2006.01)
(Continued)

(52) U.S. Cl.
CPC ..... *F21V 29/004* (2013.01); *F21K 9/13* (2013.01); *F21V 19/0055* (2013.01);
(Continued)

(58) Field of Classification Search
CPC ..... F21V 29/02–29/2293; H01L 23/28; H01L 23/40; H01L 23/42; H01L 23/44; H01L 23/46; H01L 23/367; H01L 23/3672; H01L 23/3675; H01L 23/3677; H01L 23/34; H01L 23/467; H01L 2023/4068; F21Y 2101/02; F21Y 2103/003; F21Y 2111/005; F21Y 2113/00; H01J 61/44; H01J 61/305; H01J 9/2271; H01J 9/2276; H01J 29/327; H01J 5/48; H01J 61/025; H01J 61/09; H01J 61/307; H01J 61/40; H01J 61/42; H01J 61/48; H01J 61/544; H01J 61/78
USPC ..... 313/498, 318.11, 512, 45–47
See application file for complete search history.

(56) References Cited

U.S. PATENT DOCUMENTS 1,972,790 A 9/1934 Olley
4,355,853 A 10/1982 Kourimsky
(Continued)

FOREIGN PATENT DOCUMENTS

CN 101307887 A 11/2008
DE 10 2004 042186 A1 3/2006
(Continued)

OTHER PUBLICATIONS

Nokia: Change Request: Direct Tunnel Functionality, Oct. 23, 2006, Retrieved from the Internet: URL:http://www.3gpp.org/ftp/tsg_sa/WG2_Arch/TSGS2_55_Besan/Docs/S2-063918.zi.
(Continued)

*Primary Examiner* — Anne Hines
*Assistant Examiner* — Jose M Diaz
(74) *Attorney, Agent, or Firm* — Banner & Witcoff, Ltd.

(57) ABSTRACT

A light emitting element lamp and a lighting equipment for suppressing a temperature rising of a substrate on which a light emitting element is mounted by using a reflector is described. Aspects relate to a lamp including a heat-conductive reflector, a base connected to the reflector, a heat-conductive heat radiating member, a substrate having a light emitting element mounted thereon and attached to the heat radiating member and a lighting circuit housed in the cover to light the light emitting element. Other components and features may also be included.

16 Claims, 12 Drawing Sheets

(51) Int. Cl.

| | |
|---|---|
| ***H01J 61/52*** | (2006.01) |
| ***H01K 1/58*** | (2006.01) |
| ***F21V 29/00*** | (2006.01) |
| ***F21K 99/00*** | (2010.01) |
| ***F21V 19/00*** | (2006.01) |
| ***F21V 7/00*** | (2006.01) |
| ***F21V 23/00*** | (2006.01) |
| *F21Y 101/02* | (2006.01) |
| *F21V 7/20* | (2006.01) |
| *F21Y 105/00* | (2006.01) |

(52) U.S. Cl.

CPC ..... *F21Y 2101/02* (2013.01); *F21V 7/00* (2013.01); *F21V 23/006* (2013.01); *F21K 9/1355* (2013.01); *F21K 9/135* (2013.01); *F21V 7/20* (2013.01); *F21V 29/20* (2013.01); *F21Y 2105/001* (2013.01)

(56) References Cited

U.S. PATENT DOCUMENTS

| | | | | |
|---|---|---|---|---|
| 4,503,360 | A | 3/1985 | Bedel | |
| 4,630,182 | A | 12/1986 | Moroi et al. | |
| 4,939,420 | A | 7/1990 | Lim | |
| 5,327,332 | A | 7/1994 | Hafemeister | |
| D356,107 | S | 3/1995 | Watanabe et al. | |
| 5,537,301 | A | 7/1996 | Martich | |
| 5,556,584 | A | 9/1996 | Yamazaki et al. | |
| 5,585,697 | A | 12/1996 | Cote et al. | |
| 5,587,757 | A | 12/1996 | Seamans et al. | |
| 5,632,551 | A | 5/1997 | Roney et al. | |
| 5,775,792 | A | 7/1998 | Wiese | |
| 5,785,418 | A | 7/1998 | Hochstein | |
| 5,857,767 | A | 1/1999 | Hochstein | |
| 5,947,588 | A | 9/1999 | Huang | |
| 6,095,668 | A | 8/2000 | Rykowski et al. | |
| 6,161,910 | A | 12/2000 | Reisenauer et al. | |
| 6,186,646 | B1 | 2/2001 | Wiedemer | |
| 6,234,649 | B1 | 5/2001 | Katougi | |
| 6,294,973 | B1 | 9/2001 | Kimura et al. | |
| 6,502,968 | B1 | 1/2003 | Simon | |
| 6,517,217 | B1 | 2/2003 | Liao | |
| 6,598,996 | B1 | 7/2003 | Lodhie | |
| 6,814,470 | B2 | 11/2004 | Rizkin et al. | |
| 6,936,855 | B1 | 8/2005 | Harrah | |
| 6,948,829 | B2 | 9/2005 | Verdes et al. | |
| 6,982,518 | B2 | 1/2006 | Chou et al. | |
| 7,008,078 | B2 * | 3/2006 | Shimizu et al. | 362/231 |
| 7,059,748 | B2 | 6/2006 | Coushaine et al. | |
| 7,074,104 | B2 | 7/2006 | Itaya et al. | |
| 7,111,961 | B2 | 9/2006 | Trenchard et al. | |
| 7,125,146 | B2 | 10/2006 | Willis et al. | |
| D534,038 | S | 12/2006 | Kramer et al. | |
| 7,144,140 | B2 * | 12/2006 | Sun et al. | 362/373 |
| D534,665 | S | 1/2007 | Egawa et al. | |
| 7,198,387 | B1 | 4/2007 | Gloisten et al. | |
| 7,213,940 | B1 * | 5/2007 | Van De Ven et al. | 362/231 |
| 7,226,189 | B2 | 6/2007 | Lee et al. | |
| 7,281,818 | B2 | 10/2007 | You et al. | |
| 7,300,173 | B2 | 11/2007 | Catalano et al. | |
| 7,329,024 | B2 | 2/2008 | Lynch et al. | |
| 7,331,689 | B2 | 2/2008 | Chen | |
| 7,347,589 | B2 | 3/2008 | Ge | |
| 7,431,477 | B2 | 10/2008 | Chou et al. | |
| 7,497,596 | B2 | 3/2009 | Ge | |
| 7,540,761 | B2 * | 6/2009 | Weber et al. | 439/487 |
| 7,549,774 | B2 * | 6/2009 | Tsai | 362/294 |
| 7,610,947 | B2 * | 11/2009 | Wang et al. | 165/80.3 |
| 7,631,987 | B2 | 12/2009 | Wei | |
| 7,679,096 | B1 | 3/2010 | Ruffin | |
| 7,758,223 | B2 * | 7/2010 | Osawa et al. | 362/547 |
| 7,766,512 | B2 * | 8/2010 | Chou et al. | 362/294 |
| 7,784,970 | B2 * | 8/2010 | Sun | 362/294 |
| 7,824,076 | B2 * | 11/2010 | Koester | 362/294 |
| 7,871,184 | B2 * | 1/2011 | Peng | 362/294 |
| 7,891,842 | B2 * | 2/2011 | Lu et al. | 362/267 |
| 7,919,339 | B2 | 4/2011 | Hsu | |
| 7,947,596 | B2 | 5/2011 | Takeda et al. | |
| 7,950,826 | B2 * | 5/2011 | Shin | 362/249.02 |
| 7,963,686 | B2 | 6/2011 | Hu | |
| 8,058,784 | B2 * | 11/2011 | Treurniet et al. | 313/113 |
| 8,066,417 | B2 | 11/2011 | Balazs | |
| 8,164,237 | B2 * | 4/2012 | Wen | 313/46 |
| 8,294,356 | B2 * | 10/2012 | Suwa et al. | 313/498 |
| 8,317,358 | B2 * | 11/2012 | Chou | 362/218 |
| 8,322,892 | B2 * | 12/2012 | Scordino et al. | 362/294 |
| 8,390,207 | B2 * | 3/2013 | Dowling et al. | 315/186 |
| 8,439,531 | B2 * | 5/2013 | Trott et al. | 362/364 |
| 8,500,316 | B2 * | 8/2013 | Hisayasu et al. | 362/547 |
| 8,602,579 | B2 * | 12/2013 | Van de Ven et al. | 362/96 |
| 8,616,714 | B2 * | 12/2013 | Lee et al. | 362/84 |
| 8,616,724 | B2 * | 12/2013 | Pickard et al. | 362/241 |
| 8,616,736 | B2 * | 12/2013 | Pan | 362/345 |
| 8,777,449 | B2 * | 7/2014 | Van De Ven et al. | 362/249.02 |
| 2002/0024814 | A1 * | 2/2002 | Matsuba et al. | 362/294 |
| 2003/0137838 | A1 | 7/2003 | Rizkin et al. | |
| 2003/0151917 | A1 | 8/2003 | Daughtry et al. | |
| 2004/0012955 | A1 | 1/2004 | Hsieh | |
| 2004/0109310 | A1 | 6/2004 | Galli | |
| 2004/0120156 | A1 | 6/2004 | Ryan | |
| 2004/0145898 | A1 | 7/2004 | Ase et al. | |
| 2004/0156191 | A1 | 8/2004 | Biasoli et al. | |
| 2004/0218385 | A1 | 11/2004 | Tomiyoshi et al. | |
| 2005/0007772 | A1 | 1/2005 | Yen | |
| 2005/0024864 | A1 | 2/2005 | Galli | |
| 2005/0068776 | A1 | 3/2005 | Ge | |
| 2005/0073244 | A1 | 4/2005 | Chou et al. | |
| 2005/0111234 | A1 * | 5/2005 | Martin et al. | 362/555 |
| 2005/0162864 | A1 | 7/2005 | Verdes et al. | |
| 2005/0174769 | A1 | 8/2005 | Yong et al. | |
| 2005/0243552 | A1 | 11/2005 | Maxik | |
| 2005/0254246 | A1 | 11/2005 | Huang | |
| 2006/0043546 | A1 * | 3/2006 | Kraus | 257/676 |
| 2006/0092640 | A1 | 5/2006 | Li | |
| 2006/0193130 | A1 | 8/2006 | Ishibashi | |
| 2006/0193139 | A1 | 8/2006 | Sun et al. | |
| 2006/0198147 | A1 | 9/2006 | Ge | |
| 2006/0215408 | A1 | 9/2006 | Lee | |
| 2006/0227558 | A1 * | 10/2006 | Osawa et al. | 362/351 |
| 2006/0239002 | A1 | 10/2006 | Chou et al. | |
| 2007/0002570 | A1 | 1/2007 | Souza et al. | |
| 2007/0041182 | A1 | 2/2007 | Ge et al. | |
| 2007/0091597 | A1 * | 4/2007 | Wang et al. | 362/231 |
| 2007/0096114 | A1 | 5/2007 | Aoki et al. | |
| 2007/0103904 | A1 | 5/2007 | Chen | |
| 2007/0279903 | A1 | 12/2007 | Negley et al. | |
| 2008/0002100 | A1 | 1/2008 | Kaneko et al. | |
| 2008/0037255 | A1 | 2/2008 | Wang | |
| 2008/0084701 | A1 | 4/2008 | Van De Ven et al. | |
| 2008/0089069 | A1 * | 4/2008 | Medendorp | 362/294 |
| 2008/0112170 | A1 | 5/2008 | Trott et al. | |
| 2008/0130298 | A1 | 6/2008 | Negley et al. | |
| 2008/0173883 | A1 | 7/2008 | Hussell et al. | |
| 2008/0224608 | A1 | 9/2008 | Konishi et al. | |
| 2008/0289867 | A1 | 11/2008 | Owens | |
| 2009/0059595 | A1 | 3/2009 | Ge | |
| 2009/0116229 | A1 | 5/2009 | Dalton et al. | |
| 2009/0116231 | A1 | 5/2009 | Miller | |
| 2009/0117801 | A1 | 5/2009 | Flack | |
| 2009/0135613 | A1 * | 5/2009 | Peng | 362/373 |
| 2009/0147670 | A1 | 6/2009 | Hu | |
| 2009/0161356 | A1 | 6/2009 | Negley et al. | |
| 2009/0184616 | A1 | 7/2009 | Van De Ven et al. | |
| 2009/0184646 | A1 | 7/2009 | Devaney et al. | |
| 2009/0207602 | A1 | 8/2009 | Reed et al. | |
| 2009/0294780 | A1 | 12/2009 | Chou et al. | |
| 2010/0026157 | A1 | 2/2010 | Tanaka et al. | |
| 2010/0060130 | A1 | 3/2010 | Li | |
| 2010/0067241 | A1 | 3/2010 | Lapatovich et al. | |
| 2010/0096992 | A1 * | 4/2010 | Yamamoto et al. | 315/112 |
| 2010/0207534 | A1 | 8/2010 | Dowling et al. | |
| 2010/0259935 | A1 * | 10/2010 | Scordino et al. | 362/294 |
| 2010/0277082 | A1 | 11/2010 | Reed et al. | |

(56) References Cited

U.S. PATENT DOCUMENTS

| | | | | |
|---|---|---|---|---|
| 2010/0289396 | A1* | 11/2010 | Osawa et al. | 313/46 |
| 2011/0075423 | A1* | 3/2011 | Van De Ven | 362/249.02 |
| 2011/0299284 | A1* | 12/2011 | Van De Ven et al. | 362/293 |

FOREIGN PATENT DOCUMENTS

| | | | |
|---|---|---|---|
| DE | 20 2008 016231 | U1 | 3/2009 |
| EP | 1 705 421 | A2 | 9/2006 |
| EP | 2 037 633 | A1 | 3/2009 |
| EP | 2 149 742 | A2 | 2/2010 |
| JP | 57-52706 | | 9/1982 |
| JP | 57-152706 | A | 9/1982 |
| JP | 59-035303 | A | 2/1984 |
| JP | 62-190366 | U | 12/1987 |
| JP | 63-5581 | | 1/1988 |
| JP | 63-102265 | A | 5/1988 |
| JP | 64-7402 | | 1/1989 |
| JP | 01-206505 | A | 8/1989 |
| JP | 2-91105 | | 3/1990 |
| JP | 61-35216 | A | 5/1994 |
| JP | 2000-083343 | A | 3/2000 |
| JP | 2000-173303 | A | 6/2000 |
| JP | 2000-173330 | A | 6/2000 |
| JP | 2001-243809 | A | 9/2001 |
| JP | 2002-525814 | A | 8/2002 |
| JP | 2002-280617 | A | 9/2002 |
| JP | 2003-016808 | A | 1/2003 |
| JP | 2003-059305 | A | 2/2003 |
| JP | 2003-59330 | | 2/2003 |
| JP | 2003-92022 | | 3/2003 |
| JP | 2004-119078 | A | 4/2004 |
| JP | 2004-193053 | A | 7/2004 |
| JP | 2004-6096 | | 8/2004 |
| JP | 2004-221042 | A | 8/2004 |
| JP | 2005-93097 | | 4/2005 |
| JP | 2005-123200 | A | 5/2005 |
| JP | 2005-513815 | A | 5/2005 |
| JP | 2005-166578 | A | 6/2005 |
| JP | 2005-286267 | A | 10/2005 |
| JP | 2006-040727 | A | 2/2006 |
| JP | 3121916 | | 5/2006 |
| JP | 2006-156187 | A | 6/2006 |
| JP | 2006-244725 | A | 9/2006 |
| JP | 2006-310057 | A | 11/2006 |
| JP | 2006-313717 | A | 11/2006 |
| JP | 2006-313718 | A | 11/2006 |
| JP | 2007-073306 | | 3/2007 |
| JP | 2007-188832 | A | 7/2007 |
| JP | 2007-207576 | A | 8/2007 |
| JP | 2008-027910 | A | 2/2008 |
| JP | 2008-91140 | | 4/2008 |
| JP | 2008-227412 | A | 9/2008 |
| JP | 2008-277561 | A | 11/2008 |
| JP | 2009-037995 | | 2/2009 |
| JP | 2009-37995 | | 2/2009 |
| JP | 2009-117342 | A | 5/2009 |
| JP | 2009-135026 | A | 6/2009 |
| JP | 2009-206104 | A | 9/2009 |
| WO | 03/056636 | A1 | 7/2003 |
| WO | 2005/024898 | A2 | 3/2005 |
| WO | 2008/146694 | A1 | 12/2008 |
| WO | 2009/087897 | A1 | 7/2009 |

OTHER PUBLICATIONS

Related U.S. Appl. No. 12/794,379 captured on Nov. 4, 2011.
Related U.S. Appl. No. 12/794,429 captured on Nov. 4, 2011.
Related U.S. Appl. No. 12/794,476 captured on Nov. 4, 2011.
Related U.S. Appl. No. 12/794,509 captured on Nov. 4, 2011.
Related U.S. Appl. No. 12/811,795 captured on Nov. 4, 2011.
Related U.S. Appl. No. 12/885,005 captured on Nov. 4, 2011.
Related U.S. Appl. No. 12/886,123 captured on Nov. 4, 2011.
Related U.S. Appl. No. 13/034,959 captured on Nov. 4, 2011.
English Language Abstract of JP 2008-227412 published Sep. 25, 2008.
English Language Translation of JP 2008-227412 published Sep. 25, 2008.
Related U.S. Appl. No. 12/794,476 captured from Jul. 7, 2011 to Aug. 3, 2011.
Related U.S. Appl. No. 12/794,558 captured from Jul. 7, 2011 to Aug. 3, 2011.
English Language Abstract of JP 61-35216 published Feb. 2, 1986.
English Language Translation of JP 2002-525814 published Aug. 13, 2002.
IPRP and WO issued in PCT/JP2008/073436 on Aug. 10, 2010.
English Language Abstract of JP 2006-156187 published Jun. 15, 2006.
English Language Translation of JP 2006-156187 published Jun. 15, 2006.
Extended European Search Report issued in EP 111560003.9 on May 18, 2011.
Extended European Search Report issued in EP 08838942.4 on Jun. 1, 2011.
English Language Abstract of JP 2008-277561 published on Nov. 13, 2008.
English Language Translation of JP 2008-277561 published on Nov. 13, 2008.
Related U.S. Appl. No. 12/794,379 captured from Sep. 18, 2010 to Jul. 6, 2011.
Related U.S. Appl. No. 12/794,429 captured from Sep. 18, 2010 to Jul. 6, 2011.
Related U.S. Appl. No. 12/794,476 captured from Sep. 18, 2010 to Jul. 6, 2011.
Related U.S. Appl. No. 12/794,509 captured from Sep. 18, 2010 to Jul. 6, 2011.
Related U.S. Appl. No. 12/825,650 captured on Jul. 5, 2011.
Related U.S. Appl. No. 13/044,369 captured on Jul. 6, 2011.
Related U.S. Appl. No. 12/888,921 captured on Jul. 6, 2011.
Related U.S. Appl. No. 13/034,959 captured on Jul. 6, 2011.
Related U.S. Appl. No. 13/172,557 captured on Jul. 6, 2011.
English Language Abstract of JP 2009-135026 published Jun. 18, 2009.
English Language Translation of JP 2009-135026 published Jun. 18, 2009.
English Language Abstract of JP 2002-525814 puglished Aug. 13, 2002.
English Language Abstract of JP 2003-059305 published Feb. 28, 2003.
English Language Translation of JP 2003-059305 published Feb. 28, 2003.
English Language Abstract of JP 2009-037995 published Feb. 19, 2009.
English Language Translation of JP 2009-037995 published Feb. 19, 2009.
English Language Abstract of JP 2007-188832 published Jul. 26, 2007.
English Language Translation of JP 2007-188832 published Jul. 26, 2007.
English Language Abstract of JP 2008-027910 published Feb. 7, 2008.
English Language Translation of JP 2008-027910 published Feb. 7, 2010.
English Language Abstract of JP 2007-207576 published Aug. 16, 2007.
English Language Translation of JP 2007-207576 published Aug. 16, 2007.
English Language Abstract of JP 2007-073306 published Mar. 22, 2007.
English Language Translation of JP 2007-073306 published Mar. 22, 2007.
Related U.S. Appl. No. 12/880,490 captured on Nov. 8, 2010.
Related U.S. Appl. No. 12/845,330 captured on Nov. 8, 2010.
Related U.S. Appl. No. 12/885,005 captured on Nov. 8, 2010.
Related U.S. Appl. No. 12/933,969 captured on Nov. 8, 2010.
Related U.S. Appl. No. 12/885,849 captured on Nov. 8, 2010.
Related U.S. Appl. No. 12/886,025 captured on Nov. 8, 2010.

(56) References Cited

OTHER PUBLICATIONS

Related U.S. Appl. No. 12/886,123 captured on Nov. 8, 2010.
Related U.S. Appl. No. 12/399,492 (now US Patent 7,758,223) as of Nov. 8, 2010.
Related U.S. Appl. No. 12/794,558 captured on Nov. 8, 2010.
Extended European Search Report issued on EP Applicaton 10006720.6 on Oct. 13, 2010.
English Language Abstract of JP 2001-243809, published Sep. 7, 2001.
English Language Abstract of JP Publication 01-206505 published Aug. 18, 1989.
English Language Abstract of JP Publication 2005-093097 published Apr. 7, 2005.
English Language Abstract of JP Publication 2005-123200 published May 12, 2005.
English Language Abstract of JP 2006-313718 published Nov. 16, 2006.
English Language Abstract of JP Publication 63-005581 published Jan. 11, 1988.
English Language Abstract of JP Publication 64-007402 published Jan. 11, 1989.
English Language Machine Translation of JP 2000-083343 published Mar. 21, 2000.
English Language Machine Translation of JP 2000-173303 published Jun. 23, 2000.
English Language Machine Translation of JP 2001-243809 pbulished Sep. 7, 2001.
Englihs Language Machine Translation of JP 2004-006096 published Jan. 8, 2004.
English Language Machine Translation of JP 2004-193053 published Jul. 8, 2004.
English Language Machine Translation of JP 2005-166578 published Jun. 23, 2005.
English Language Machine Translation of JP 2005-513815 published May 12, 2005.
English Language Machine Translation of JP 2006-040727 published Feb. 9, 2006.
English Language Machine Translation of JP 2006-310057 published Nov. 9, 2006.
English Language Machine Translation of JP 2006-313718 published Nov. 16, 2006.
English Language Machine Translation of JP 2009-37995 published Feb. 19, 2009.
English Language Machine Translation of JP 3121916 published May 10, 2006.
English Language Machine Translation of JP Publication 2005-093097 published Apr. 7, 2005.
English Language Machine Translation of JP Publication 2005-123200.
English Language Machine Translation of JP 2003-092022 published Mar. 28, 2003.
English Language Translation of Office Action issued in corresponding JP application 2005-221571 on Oct. 20, 2009.
English Language Translation of International Search Report for PCT/JP2008/073436 mailed Mar. 24, 2009.
English Translation of OA issued in corresponding JP application 2005-221571 on Jul. 7, 2009.
English Translation of OA issued in corresponding JP application 2005-221571 on Aug. 25, 2009.
English Language Translation of OA issued in JP application 2005-221688 on Jan. 26, 2010.
Office Action issued in corresponding JP application 2005-221571 on Jul. 7, 2009.
Office Action issued in corresponding JP application 2005-221571 on Aug. 25, 2009.
Office Action issued in corresponding JP application 2005-221571 on Oct. 20, 2009.
English Language Abstract of JP 2004-193053 published Jul. 8, 2004.
English Language Abstract of JP 2-91105 published Mar. 30, 1990.
English Language Abstract of JP 2000-173303 published Jun. 23, 2000.
English Language Abstract of JP 2003-092022 published Mar. 28, 2003.
English Language Abstract of JP 2005-166578 published Jun. 23, 2005.
English Language Abstract of JP 2006-040727 published Feb. 9, 2006.
English Language Abstract of JP 2004-006096 published Jan. 8, 2004.
Office Action issued in JP application 2005-221688 on Jan. 26, 2010.
English Language Abstract of JP 2009-37995 published Feb. 19, 2009.
English Language Abstract of JP 2000-083343 published Mar. 21, 2000.
English Language Abstract of JP 57-52706 published Sep. 21, 1982.
English Language Abstract of JP 2006-310057 published Nov. 9, 2006.
IPRP and WO issued in PCT/JP2008/068625 mailed May 11, 2010.
Office Action issued in JP application 2005-371406 on Apr. 20, 2010.
Related U.S. Appl. No. 12/794,379 captured on Jul. 17, 2012.
Related U.S. Appl. No. 12/794,429 captured on Jul. 17, 2012.
Related U.S. Appl. No. 12/794,476 captured on Jul. 17, 2012.
Related U.S. Appl. No. 12/794,509 captured on Jul. 17, 2012.
Related U.S. Appl. No. 12/811,795 captured on Jul. 17, 2012.
Related U.S. Appl. No. 12/713,230 captured on Jul. 17, 2012.
Related U.S. Appl. No. 12/825,956 captured on Jul. 17, 2012.
Related U.S. Appl. No. 12/845,330 captured on Jul. 17, 2012.
Related U.S. Appl. No. 12/885,005 captured on Jul. 17, 2012.
Related U.S. Appl. No. 12/933,969 captured on Jul. 17, 2012.
Related U.S. Appl. No. 12/886,025 captured on Jul. 17, 2012.
Related U.S. Appl. No. 12/886,123 captured on Jul. 17, 2012.
Related U.S. Appl. No. 12/888,921 captured on Jul. 17, 2012.
Related U.S. Appl. No. 13/221,551 captured on Jul. 17, 2012.
English Language Abstract of JP 2004-119078 published Apr. 15, 2004.
English Language Translation of JP 2004-119078 published Apr. 15, 2004.
Chinese Office Action issued in CN 201010121809.11 on Mar. 31, 2012.
English Translation of Chinese Office Action issued in CN 201010121809.11 on Mar. 31, 2012.
English Language Abstract and Claims of CN201149860 published Nov. 12, 2008.
English Language Abstract and Claims of CN201072113 published Jun. 11, 2008.
English Language Abstract of CN2602514 published Feb. 4, 2004.
Chinese Office Action issued in CN 201010216943 on Oct. 26, 2011.
English Language Translation of Chinese Office Action issued in CN 201010216943 on Oct. 26, 2011.
English Language Abstract of CN 101307887 published Nov. 19, 2008.
English Language Translation of JP 2009/117342 published May 28, 2009.
English Language Abstract of JP 2009-117342 published May 28, 2009.
Related U.S. Appl. No. 12/794,379 captured on Mar. 5, 2012.
Related U.S. Appl. No. 12/794,429 captured on Mar. 5, 2012.
Related U.S. Appl. No. 12/794,476 captured on Mar. 5, 2012.
Related U.S. Appl. No. 12/794,509 captured on Mar. 5, 2012.
Related U.S. Appl. No. 12/811,795 captured on Mar. 5, 2012.
Related U.S. Appl. No. 12/885,005 captured on Mar. 5, 2012.
Related U.S. Appl. No. 12/933,969 captured on Mar. 5, 2012.
Related U.S. Appl. No. 12/886,025 captured on Mar. 5, 2012.
Related U.S. Appl. No. 12/886,123 captured on Mar. 5, 2012.
Related U.S. Appl. No. 13/044,369 captured on Mar. 5, 2012.
Related U.S. Appl. No. 13/221,519 captured on Mar. 5, 2012.
Japanese Office Action issued in 2005-269017 on Jan. 13, 2011.
English Language Translation of Japanese Office Action Issued in 2005-269017 on Jan. 13, 2011.
English Language Abstract of JP 2004-221042 published Aug. 5, 2004.

(56) References Cited

OTHER PUBLICATIONS

English Language Translation of JP 2004-221042 published Aug. 5, 2004.
English Language Abstract of JP 63-102265 published May 7, 1988.
English Language Abstract of JP 2009-206104 published Sep. 10, 2009.
English Language Translation of JP 2009-206104 published Sep. 10, 2009.
EP Search Report issued in EP 10178361.1 on Jul. 4, 2011.
Related U.S. Appl. No. 13/221,519 captured on Nov. 4, 2011.
Related U.S. Appl. No. 13/221,551 captured on Nov. 4, 2011.
International Search Report issued in EP 07721252 on Sep. 23, 2011.
Huwaei: "One Solution to Error Indication for SGSN controlled bearer optimization", 3GPP Draft; S2-062756, 3rd Generation Partnership Project (3GPP), Mobile Competence Centre; 650, Route Des Lucioles; F-06921 Sophia-Antipolis Cedex; France, vol. SA WG2, No. Sophia; Aug. 18, 2006.
"One Tunnel Functional Description (Release 7)", Sep. 2006, retrieved from the Internet: URL:http://www.3gpp.org/ftp/Specs/archive/23_series23.809/23809-100.zip.
English Translation of OA issued in JP application 2005-371406 on Apr. 20, 2010.
Related U.S. Appl. No. 12/825,650 captured on Sep. 17, 2010.
Related U.S. Appl. No. 12/794,379 captured on Sep. 17, 2010.
Related U.S. Appl. No. 12/794,429 captured on Sep. 17, 2010.
Related U.S. Appl. No. 12/794,476 captured on Sep. 17, 2010.
Related U.S. Appl. No. 12/794,509 captured on Sep. 17, 2010.
Related U.S. Appl. No. 12/794,558 captured on Sep. 17, 2010.
Related U.S. Appl. No. 12/811,795 captured on Sep. 17, 2010.
Related U.S. Appl. No. 12/713,230 captured on Sep. 17, 2010.
Related U.S. Appl. No. 12/825,856 captured on Sep. 17, 2010.
JP Office Action issued in JP 2008-198625 on May 26, 2010.
English Translation of JP Office Action issued in JP 2008-198625 on May 26, 2010.
Amendment filed in JP 2008-198625 on Jun. 28, 2010.
English Translation of Amendment filed in JP 2008-198625 on Jun. 28, 2010.
English Language Abstract of JP 2006-313717 published Nov. 16, 2006.
Machine English Translation of JP 2006-313717 published Nov. 16, 2006.
English Language Abstract of JP 2008-91140 published Apr. 17, 2008.
Machine English Translation of JP 2008-91140 published Apr. 17, 2008.
English Language Abstract of 2003-59330 published Feb. 28, 2003.
Machine English Language Transation of JP 2003-59330 published Feb. 28, 2003.
Search Report of International application No. PCT/JP2008/068625 mailed Dec. 9, 2008.
English Language Abstract of JP 2005-286267.
English Language Abstract of JP 2002-280617.
English Language Abstract of JP 2003-016808.
English Language Abstract of JP 2006-244725.
Machine English Language translation of JP 2005-286267.
Machine English Language translation of JP 2002-280617.
Machine English Language translation of JP 2003-016808.
Machine English Language translation of JP 2006-244725.
Non-Final Office Action for related U.S. Appl. No. 12/738,081 mailed Nov. 10, 2010.
Final Office Action for related U.S. Appl. No. 12/738,081 mailed Aug. 5, 2011.
Non-Final Office Action for related U.S. Appl. No. 12/738,081 mailed Dec. 5, 2011.
Final Office Action for related U.S. Appl. No. 12/738,081 mailed Apr. 18, 2012.
Notice of Allowance for related U.S. Appl. No. 12/738,081 mailed Oct. 11, 2012.

* cited by examiner

LIGHT EMITTING ELEMENT LAMP AND LIGHTING EQUIPMENT

CROSS-REFERENCE TO RELATED APPLICATIONS

This application is a continuation of U.S. patent application Ser. No. 12/738,081 filed Apr. 15, 2010, which is the National Stage Entry of and claims the benefit of priority from prior PCT Application No. PCT/JP2008/068625, filed Oct. 15, 2008. The entire contents of the above noted applications are incorporated herein by reference.

FIELD

Aspects described herein relate to a light emitting element lamp in which a light emitting element such as an LED (light emitting diode) is applied as a light source, and to lighting equipment which uses the light emitting element lamp.

BACKGROUND

Light emitting elements such as LEDs are reduced in light output performance as the temperature thereof rise. The temperature rise also affects operating lifetime thereof. Thus, in a lamp in which a solid-state light emitting element such as an LED or an EL element is used as a light source, it is necessary to suppress the temperature of the light emitting element from rising to thereby improve various characteristics such as operating lifetime and efficiency. An LED lamp in which a cylindrical heat radiator is provided between a substrate on which LEDs are provided and a base, and the substrate is attached to a rim of the cylindrical heat radiator to thereby effectively radiate heat has been known as this type of LED lamp.

DETAILED DESCRIPTION

Figure 1:
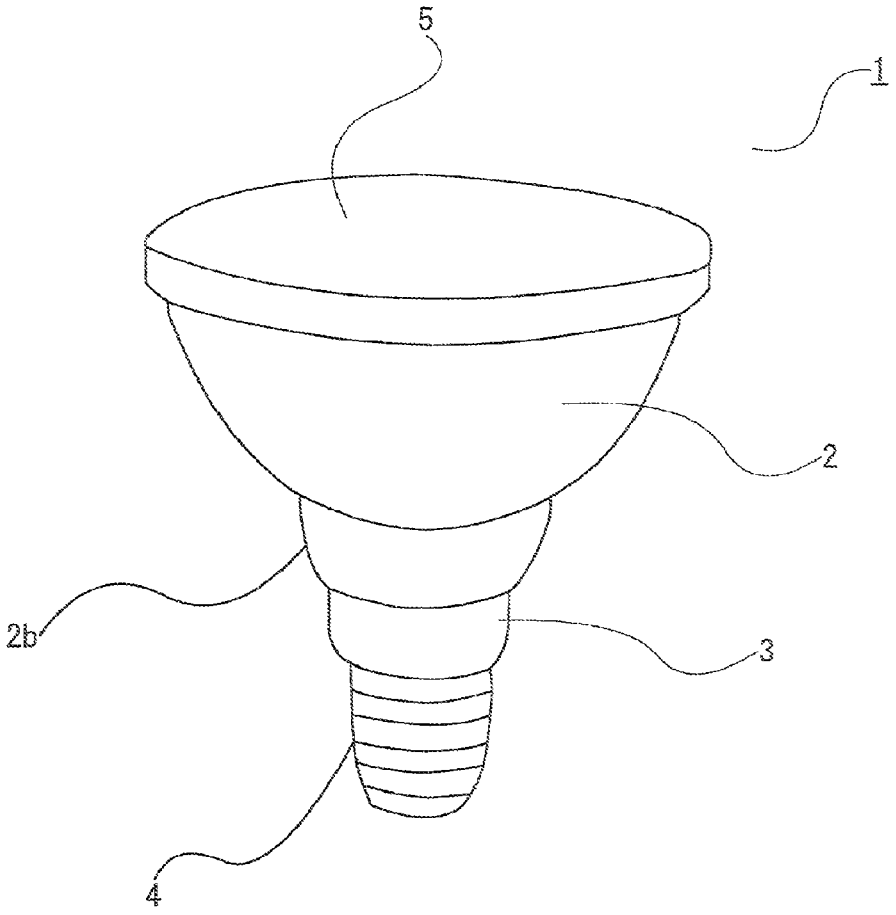
FIG. 1 is a perspective view illustrating a light emitting element lamp according to a first embodiment of the present invention.

In some known LED lamps, a heat radiator is provided specially for the purpose of radiating heat, and a substrate is disposed so as to be in contact only with a rim of the heat radiator. In other words, the heat radiator and the substrate are only in line contact with each other. Thus, it may be difficult to obtain a sufficient heat radiation effect.

Aspects described herein have been made in view of the circumstances mentioned above, and provide a light emitting element lamp and a lighting equipment or apparatus capable of effectively suppressing a temperature rising of a substrate, on which a light emitting element is mounted, by use of a reflector.

A light emitting element lamp according to aspects described herein includes: a heat-conductive reflector provided with an emission opening portion and formed to be widened toward the emission opening portion, and having a reflecting surface being provided on an inner surface side and an outer peripheral surface being exposed to an outside; a base connected to the reflector through a cover; a heat-conductive heat radiating member provided on the inner peripheral surface of the reflector and thermally connected to the reflector; a substrate having a light emitting element mounted thereon and attached to the heat radiating member with a substrate surface being thermally connected to the heat radiating member in a surface contact state; a lighting circuit, housed in the cover to light the light emitting element; and a translucent cover covering the emission opening portion of the reflector.

The light emitting element includes an LED, an organic EL element or the like. The cover portion may be provided integrally with or separately from the reflector. The light emitting element is preferably mounted by chip-on-board technology or surface-mount technology. Because of the nature of the present invention, however, a mounting method is not particularly limited. For example, a bullet-shaped LED may also be mounted on the substrate. The number of light emitting elements to be mounted is also not particularly limited. The lighting circuit may be entirely housed in the cover portion, or may be partially housed in the cover portion with a remaining portion being housed in the base, for example. The reflecting surface may not be provided on the inner surface side of the reflector, but may be provided on the light emitting element side thereof. Moreover, the reflector may be widened continuously, or may be widened gradually, that is, in a discontinuous shape, in a light emitting direction. An E-type base having a threaded shell is most preferable as the base. However, a pin-type base may also be used. The disclosure of "A substrate surface being thermally connected to the heat radiating member in a surface contact state" means not only that the substrate surface is in direct contact with the heat radiating member, but also that the substrate surface is indirectly connected to the heat radiating member via a heat-conductive member.

According to further aspects, since heat generated from the substrate by lighting the light emitting element can be effectively radiated by using the relatively large outer peripheral surface of the reflector having a shape widened toward the emission opening portion, the temperature rising of the light emitting element lamp can be effectively suppressed.

According to some aspects, it may be preferred that the heat radiating member has a surface continuous to the inner peripheral surface of the reflector. Accordingly, since the heat radiating member forms the continuous surface with the inner peripheral surface of the reflector, a contacting surface area is increased, and a reflecting function is not deteriorated.

Furthermore, it may be desired that the heat radiating member is formed integrally with the reflector. Accordingly, since the heat radiating member is formed integrally with the reflector, good heat conductivity can be achieved.

According to other aspects, the lighting equipment is composed of an equipment body having a socket and a light emitting element lamp mounted to the socket of the equipment body.

Figure 2:
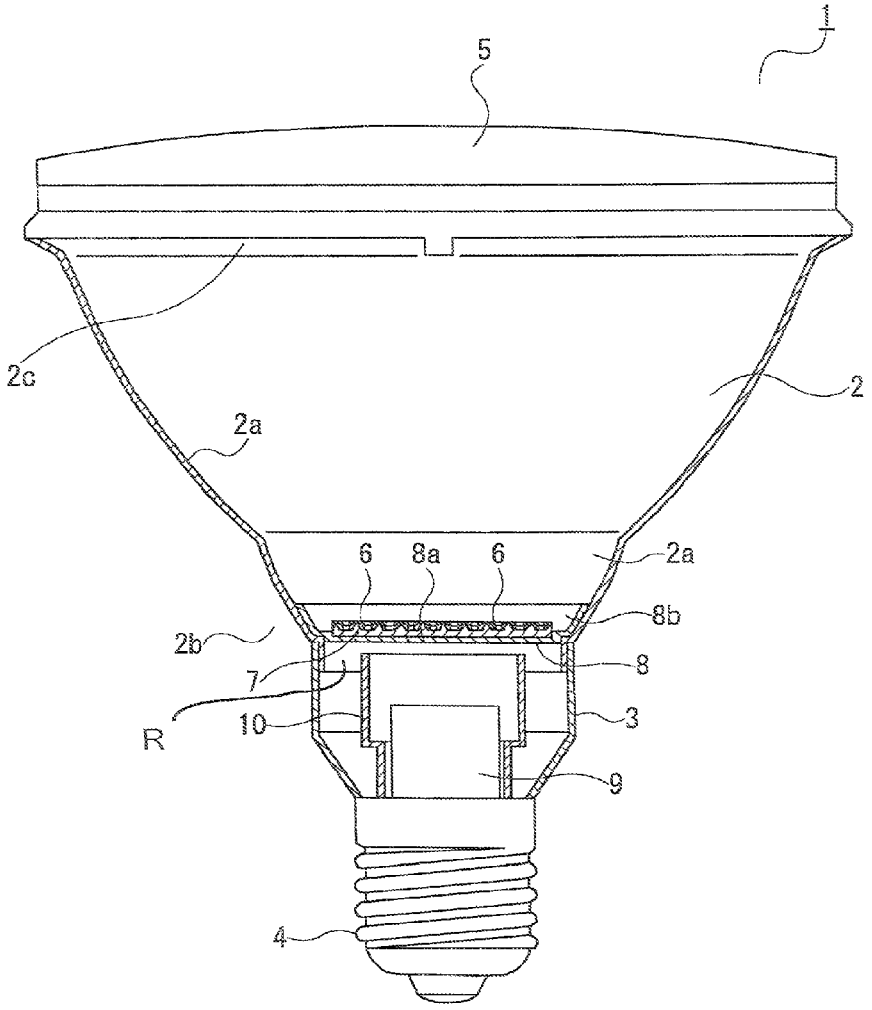
FIG. 2 is a sectional elevation view illustrating the portion of the light emitting element lamp shown in FIG. 1.
Figure 3:
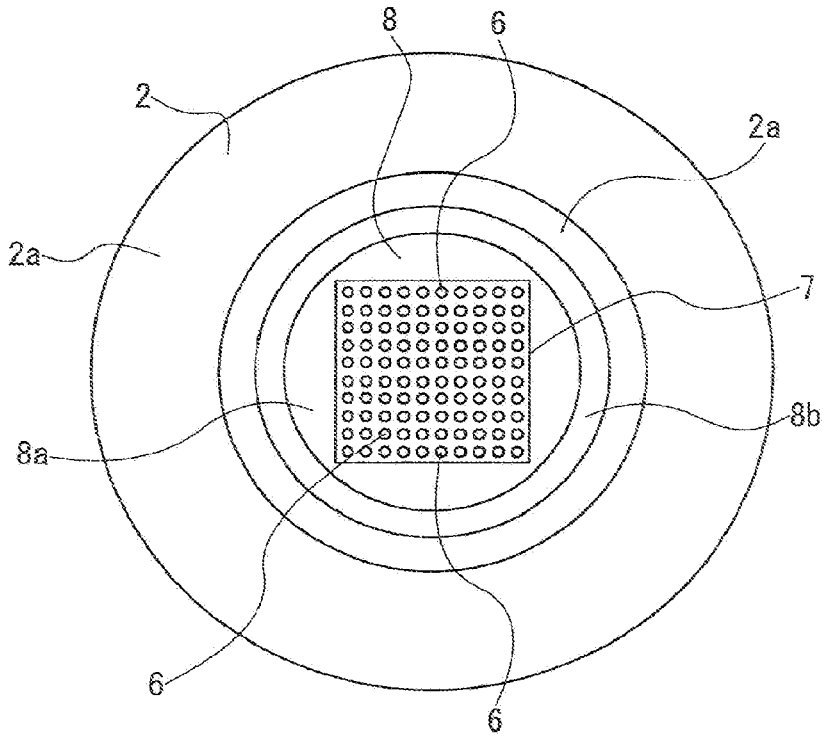
FIG. 3 is a schematic top plan view illustrating the light emitting element lamp of FIG. 1.

In the following, a light emitting element lamp according to a first embodiment of the present invention will be described with reference to FIGS. 1 to 3. FIG. 1 is a perspective view illustrating the light emitting element lamp. FIG. 2 is a sectional elevation view illustrating a portion of the light emitting element lamp. FIG. 3 is a schematic top view illustrating the light emitting element lamp with a translucent cover being removed therefrom.

It is first to be noted that a following description is based on the assumption that the light emitting element lamp according to the present embodiment may be mounted instead of an existing reflective incandescent light bulb referred to as a so-called beam lamp, and has an outer appearance and dimensions substantially equivalent to those of the beam lamp.

The beam lamp is suitable for spotlights used in various stores, floodlights for lighting buildings or signs, and lights at construction sites or the like.

Figure 5:
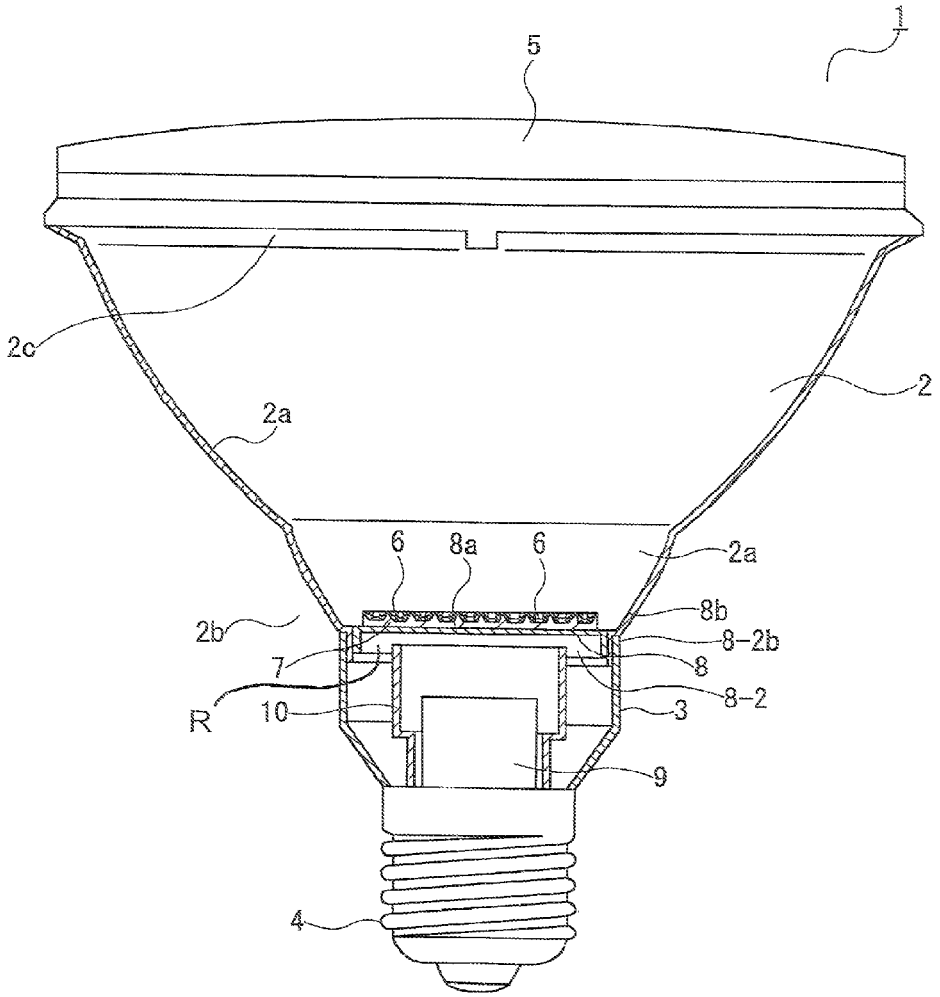
FIG. 5 is a sectional elevation view illustrating a light emitting element lamp according to a third embodiment, corresponding to the portion of FIG. 2.
Figure 6:
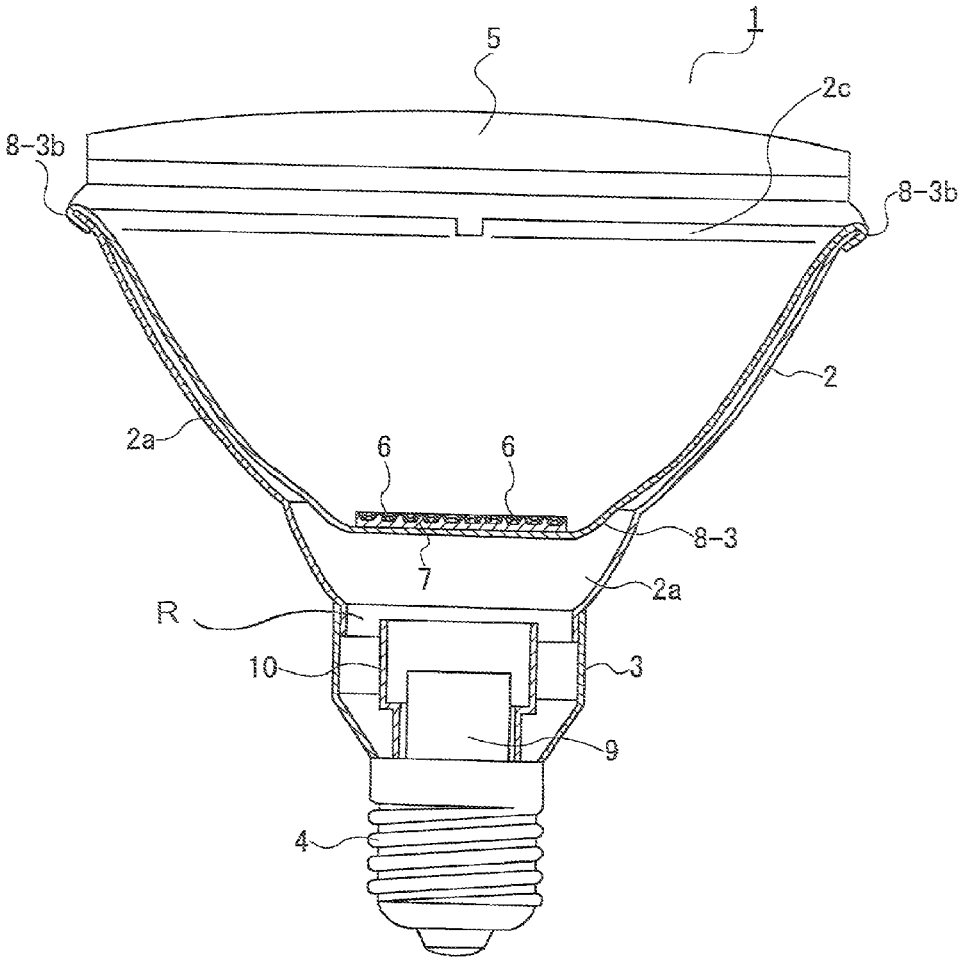
FIG. 6 is a sectional elevation view illustrating a light emitting element lamp according to a fourth embodiment, corresponding to the portion of FIG. 2.

As shown in FIGS. 1 and 2, a light emitting element lamp 1 has an outer appearance similar to that of the existing beam lamp. The light emitting element lamp 1 includes a reflector 2, a cover portion 3, a base 4, and a front lens 5 as a translucent cover. The reflector 2 is formed as an integrally molded article of aluminum, for example. The reflector 2 is formed in a bowl shape so as to be widened from a base portion 2*b* toward an emission opening portion 2*c* on one side with a reflecting surface 2*a* being provided on an inner surface side and an outer peripheral surface being exposed to an outside. As shown in FIGS. 2, 5 and 6, a recessed portion R is formed in an inner peripheral surface on another end side of the base portion 2*b*. The reflector 2 may be made of not only aluminum, but also a metal material or a resin material having good heat conductivity.

Similarly, the cover portion 3 is an integrally molded article of aluminum, for example, which is formed in a substantially cylindrical shape. The base portion 2*b* of the reflector 2 is fixed to one end of the cover portion 3, and the base 4 is fixed to the other end thereof. The base 4 is a standard E26 base. The base 4 is screwed into a lamp socket of a lighting equipment or apparatus when the light emitting element lamp 1 is mounted in the lighting equipment. The front lens 5 is attached to the reflector 2 via a seal so as to hermetically cover the opening portion 2*c* of the reflector 2. A collecting lens or a diffusing lens may be selected according to the intended use as the front lens 5. Basically, components of the existing beam lamp are directly used as the components (the reflector 2, the cover portion 3, the base 4, and the front lens 5) mentioned above.

Subsequently, a light emitting element as a light source is provided in the base portion 2*b* of the reflector 2. The light emitting element is an LED chip 6. The LED chips 6 are mounted on a printed substrate 7 using chip-on-board technology. That is, 100 LED chips 6 are disposed in a matrix of 10 columns and 10 rows on a front surface of the printed substrate 7. A coating material is applied to surfaces of the LED chips 6. The printed substrate 7 is a substantially square flat plate of metal or an insulating material (see FIG. 3).

When the printed substrate 7 is made of metal, a material having good heat conductivity and excellent in heat radiation property such as aluminum is preferably used. When the printed substrate 7 is made of an insulating material, a ceramic material or a synthetic resin material having relatively good heat radiation property and excellent in durability may be used. In the case where the synthetic resin material is used, glass epoxy resin or the like may be employed, for example.

The substrate 7 is bonded to a heat radiating member 8 with an adhesive. A material having good heat conductivity obtained by mixing a metal oxide or the like into a silicone resin adhesive is preferably used as the adhesive. The heat radiating member 8 is an integrally molded article of aluminum, and is formed in a substantially circular disc shape. The heat radiating member 8 has a flat mounting surface 8*a* on which the substrate 7 is to be mounted.

A flange portion 8*b* is formed from the mounting surface 8*a* in an outer circumferential direction. To mount the substrate 7 on the heat radiating member 8, the adhesive is first applied to the mounting surface 8*a* of the heat radiating member 8, and a rear surface of the substrate 7 is then attached thereto such that the substrate 7 is brought into surface contact with the heat radiating member 8.

The flange portion 8*b* of the heat radiating member 8 is formed on the inner surface side of the reflector 2, that is, in a shape along the reflecting surface 2*a*, and is thereby mounted on the reflector 2 in close surface contact therewith. The adhesive having good heat conductivity as described above is also preferably used to mount the flange portion 8*b* on the reflector 2. That is, the heat radiating member 8 forms a continuous surface with the reflecting surface 2*a* of the reflector 2.

A lighting circuit 9 is housed in the cover portion 3. The lighting circuit 9 is used for lighting the LED chips 6. Components such as a capacitor and a transistor as a switching element are mounted on a circuit board of the lighting circuit 9. A lead wire extends from the lighting circuit 9 so as to be electrically connected to the printed substrate 7 and the base 4, not shown.

An insulating protection tube 10 for electrically insulating the lighting circuit 9 is arranged around the lighting circuit 9. The lighting circuit 9 may be entirely housed within the cover portion 3, or may be partially housed within the cover portion 3 with a remaining portion being housed within the base 4.

An operation of the light emitting element lamp 1 having the components or structure mentioned above will be described hereunder.

When the light emitting element lamp 1 is electrified by mounting the base 4 in a socket of a lighting equipment, the lighting circuit 9 is activated to supply power to the substrate 7. The LED chips 6 thereby emit light. The light emitted from the LED chips 6 mostly passes directly through the front lens 5 to be projected frontward. The light is partially reflected by the reflecting surface 2*a* of the reflector 2, and passes through the front lens 5 to be projected frontward. Meanwhile, heat generated from the LED chips 6 in association therewith is mainly conducted to the heat radiating member 8, through the adhesive from substantially the entire rear surface of the substrate 7.

The heat is further conducted through the flange portion 8*b* of the heat radiating member 8 to the reflector 2 having a large heat radiation area in surface contact with the flange portion 8*b*, and is radiated therefrom. The respective members are thermally connected to each other as described above, so that a temperature rising of the substrate 7 can be suppressed by radiating the heat through the heat conducting path.

According to the present embodiment, the temperature rising of the substrate 7 on which the LED chips 6 are mounted can be effectively suppressed by use of the reflector 2. Since the substrate 7 is in surface contact with the heat radiating member 8, good heat conductivity will be achieved. Since the heat radiating member 8 is also in surface contact with the reflector 2, good heat conductivity will be also achieved. As a result, the heat radiation property can be improved. Furthermore, since the reflector 2 flares in a light emitting direction, the outer peripheral surface that produces a heat radiation effect has a large area, and is provided away from the lighting circuit 9 that is another heat generating source and requires thermal protection. Thus, it is effective to utilize the reflector 2 as a heat radiating element to suppress the temperature rising of the substrate 7.

Moreover, since the heat radiating member 8, particularly, the flange portion 8*b* has the shape along the reflecting surface 2*a* to form the continuous surface with the reflecting surface 2*a* of the reflector 2, the heat radiating member 8 is less likely to deteriorate a reflection effect of the reflecting surface 2*a*. Additionally, since the components of the existing so-called beam lamp can be used, the components can be shared between the light emitting element lamp and the existing beam lamp, so that the light emitting element lamp can be provided at a low cost.

Figure 4:
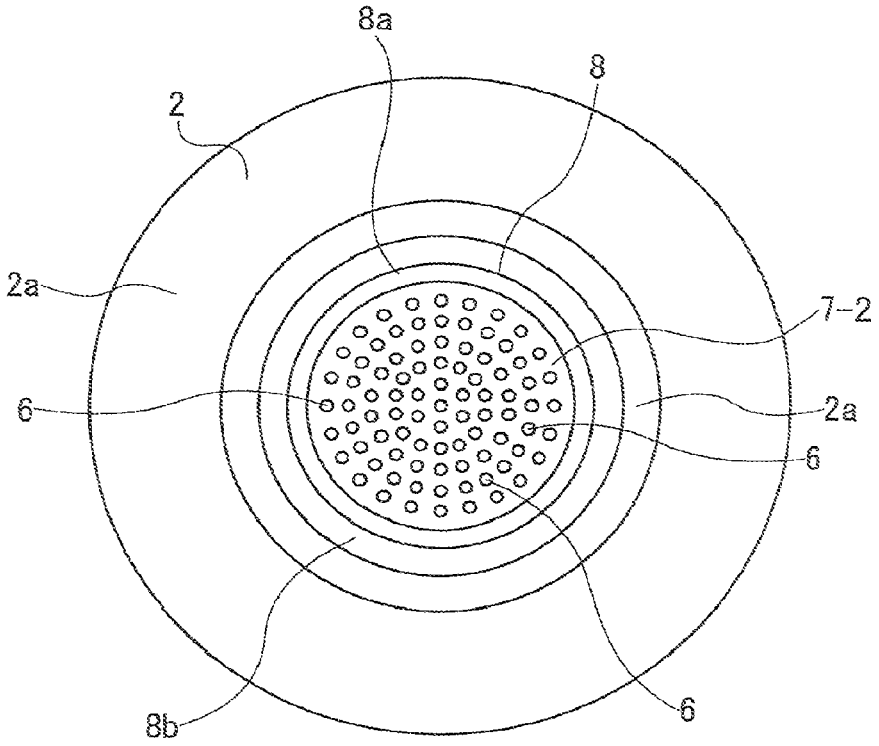
FIG. 4 is a schematic top plan view illustrating a light emitting element lamp according to a second embodiment of the present invention.

Hereunder, a light emitting element lamp according to a second embodiment of the present invention will be described with reference to FIG. 4, which is a schematic top plan view illustrating the light emitting element lamp with a translucent cover being removed therefrom, and corresponds to FIG. 3 in the first embodiment. The same or corresponding portions as those of the first embodiment are assigned with the same reference numerals, and duplicated description is omitted herein.

A printed substrate 7-2 is a circular flat plate. The LED chips 6 are regularly mounted on the circular plate. The circular printed substrate 7-2 is disposed substantially concentrically with the heat radiating member 8 and the reflector 2 as shown in the drawing.

According to the present embodiment, since a heat conducting distance between a circular outer periphery of the printed substrate 7-2 and the reflector 2 is constant, the temperature rise of the printed substrate 7-2 can be substantially uniformly suppressed in addition to the effect described in the first embodiment.

Light emitting element lamps according to third to fifth embodiments of the present invention will be described hereunder with reference to FIGS. 5 to 7, respectively.

The same or corresponding portions as those of the first embodiment are assigned with the same reference numerals, and duplicated description is omitted herein.

The third to fifth embodiments are different from the first embodiment in a configuration or structure of the heat radiating member 8.

First, FIG. 5 is a sectional elevation view illustrating an essential portion of the light emitting element lamp according to the third embodiment. A heat radiating member 8-2 has a cap shape. The heat radiating member 8-2 is bonded to the base portion 2*b* of the reflector 2 with the adhesive with an outer peripheral surface 8-2*b* being in close surface contact with the base portion 2*b*.

According to the present embodiment, in a similar manner to the first embodiment, heat generated from the LED chips 6 is conducted to the heat radiating member 8-2 through the adhesive from substantially the entire rear surface of the substrate 7. The heat is further conducted through the outer peripheral surface 8-2*b* of the heat radiating member 8-2 to the reflector 2 having a large heat radiation area in surface contact with the outer peripheral surface 8-2*b*, and is radiated therefrom. The temperature rising of the substrate 7 can be thereby suppressed. Furthermore, since the heat radiating member 8-2 forms a continuous surface with the reflecting surface 2*a* of the reflector 2 without projecting therefrom, the heat radiating member 8-2 does not deteriorate the reflection effect of the reflecting surface 2*a*.

FIG. 6 is a sectional elevation view illustrating the light emitting element lamp according to the fourth embodiment. A heat radiating member 8-3 is formed in substantially the same shape as that of the reflector 2, and is mounted thereon so as to enclose a rim of the emission opening portion 2*c* of the reflector 2 from the inner side toward the outer side in a surface contact state. In this embodiment, heat generated from the LED chips 6 is also conducted to the heat radiating member 8-3 through the adhesive from substantially the entire rear surface of the substrate 7. The heat is further conducted through an opening rim 8-3*b* of the heat radiating member 8-3 to the rim, of the emission opening portion 2*c* of the reflector 2 in surface contact with the opening rim 8-3*b*, is conducted to the outer peripheral surface of the reflector 2 having a large heat radiation area, and is effectively radiated therefrom. The temperature rising of the substrate 7 can be thereby suppressed.

Figure 7:
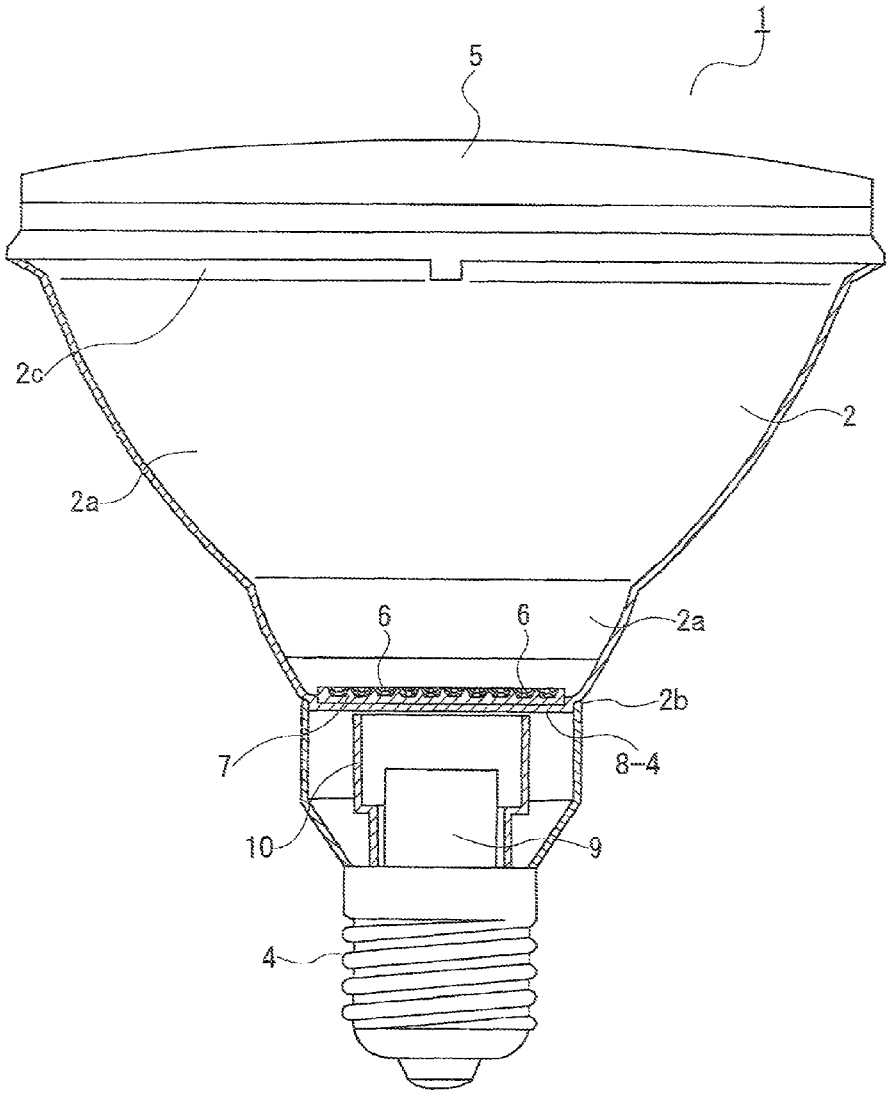
FIG. 7 is a sectional elevation view illustrating a light emitting element lamp according to a fifth embodiment, corresponding to the portion of FIG. 2.

FIG. 7 is a sectional elevation view illustrating the light emitting element lamp according to the fifth embodiment. A heat radiating member 8-4 is formed integrally with the base portion 2*b* of the reflector 2. According to the present embodiment, heat generated from the LED chips 6 is conducted to the heat radiating member 8-4 through the adhesive from substantially the entire rear surface of the substrate 7. The heat is further directly conducted to the reflector 2 having a large heat radiation area and is radiated therefrom. The temperature rising of the substrate 7 can be thereby suppressed. Since the heat radiating member 8-4 is integrated with the reflecting surface 2*a* of the reflector 2 and forms a continuous surface with the reflecting surface 2*a* without projecting therefrom, the heat radiating member 8-4 does not deteriorate the reflection effect of the reflecting surface 2*a*.

Figure 8:
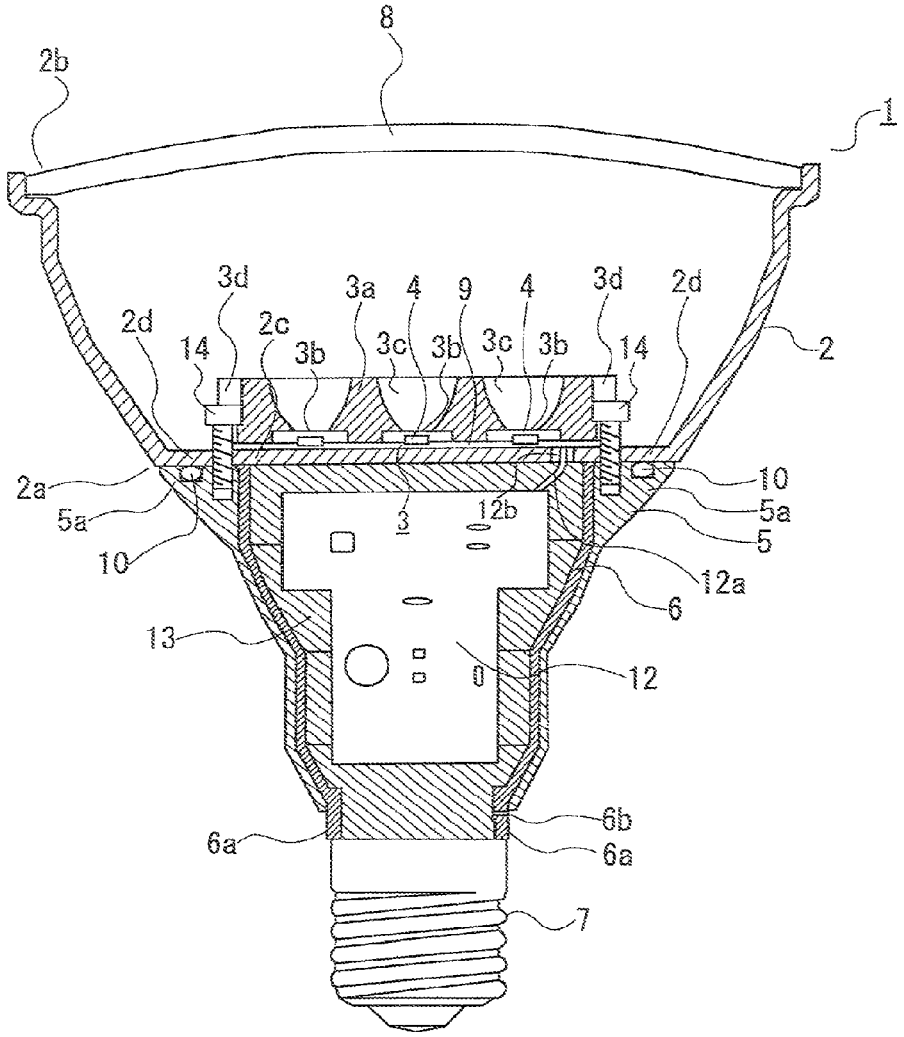
FIG. 8 is a sectional view illustrating a light emitting element lamp according to a sixth embodiment (Example 1).
Figure 9:
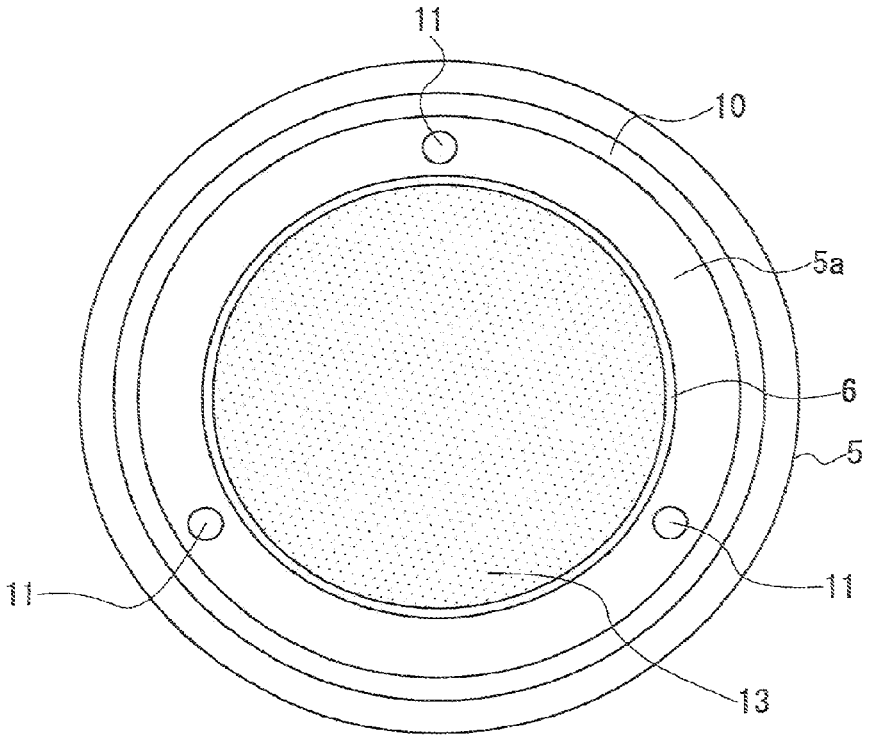
FIG. 9 is a plan view illustrating the light emitting element lamp of FIG. 8 with a first reflector being removed therefrom.
Figure 10:
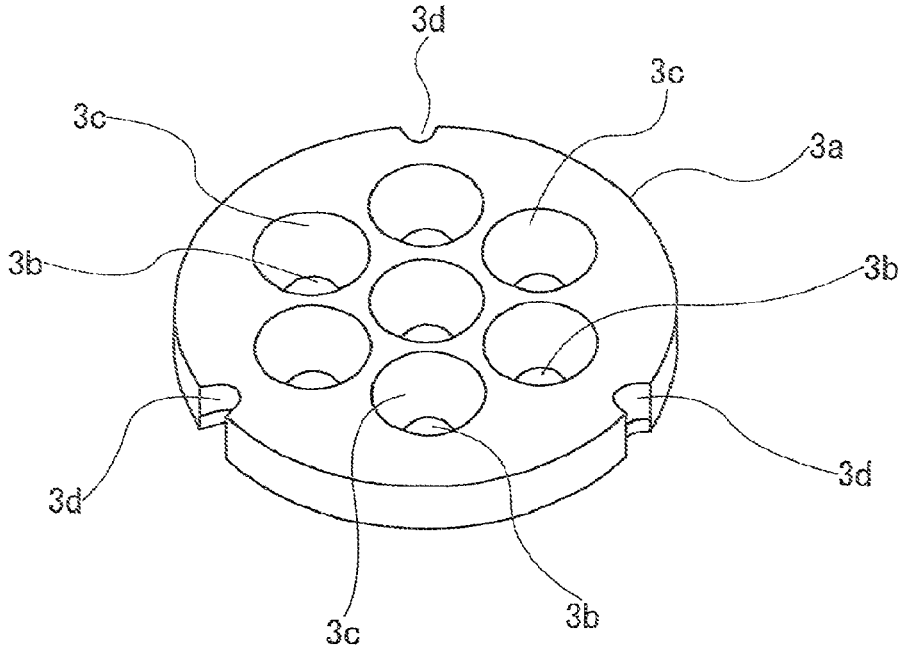
FIG. 10 is a perspective view illustrating a second reflector of the light emitting element lamp of FIG. 8
Figure 11:
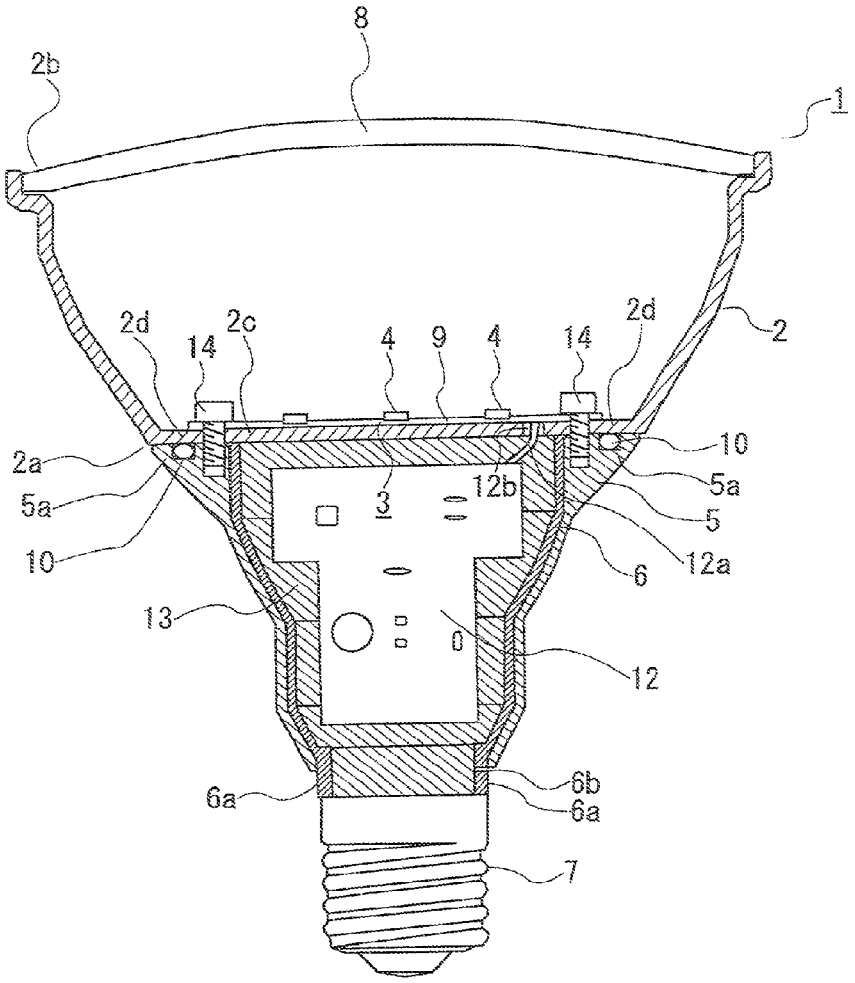
FIG. 11 is a sectional view illustrating a light emitting element lamp according to the sixth embodiment (Example 2).

Next, a light emitting element lamp according to a sixth embodiment of the present invention will be described with reference to FIGS. 8 to 11. FIG. 8 is a sectional view illustrating a light emitting element lamp (Example 1). FIG. 9 is a plan view illustrating the light emitting element lamp with a first reflector being removed therefrom. FIG. 10 is a perspective view illustrating a second reflector. FIG. 11 is a sectional view illustrating a light emitting element lamp (Example 2).

The light emitting element lamp according to the present embodiment is a lamp referred to as a so-called beam lamp in a similar manner to the first embodiment. The heat radiating member is formed integrally with the reflector in a similar manner to the fifth embodiment.

EXAMPLE 1

As show in FIG. 8, a light emitting element lamp 1 has an outer appearance similar to that of the existing beam lamp, and has a waterproof function to be appropriately used outdoors. The light emitting element lamp 1 includes a heat-conductive first reflector 2, a light source portion 3, a second reflector 3*a*, a light emitting element 4, a heat-conductive cover 5, an insulating cover 6, a base 7 and a front lens 8 as a translucent cover.

The first reflector 2 is an integrally molded article of aluminum, for example, and white acrylic baking paint is applied thereon. The first reflector 2 is formed in a bottomed bowl shape so as to flare (be widened) from a base portion 2*a* toward an emission opening portion 2*b* with an outer peripheral surface being exposed to an outside. A bottom wall of an inner peripheral surface has a flat surface, and a heat radiating member 2*c* is formed integrally therewith. Meanwhile, a bottom wall rim of the outer peripheral surface forms a ring-shaped connection portion 2*d* to be connected to the heat-conductive cover 5 described below. Three threaded through holes are formed in the bottom wall with an interval of about 120 degrees therebetween.

The first reflector 2 may be made of not only aluminum, but also a metal material or a resin material having good heat conductivity. Furthermore, alumite treatment is preferably applied to the inner peripheral surface of the first reflector 2. By applying the alumite treatment, a heat radiation effect of the first reflector 2 can be improved. When the alumite treatment is applied thereto, although a reflection effect of the inner peripheral surface of the first reflector 2 is reduced, the reduction in reflection effect does not degrade the performance of the light emitting element lamp as the second reflector 3*a* described below is separately provided. Further, in order to improve the reflection effect of the first reflector 2, the inner peripheral surface may be mirror-finished or the like.

The light source portion 3 is provided on the bottom wall of the first reflector 2. The light source portion (unit or section) 3 includes a substrate 9 and the light emitting elements 4 mounted on the substrate 9. The light emitting elements 4 are LED chips, which are mounted on the substrate 9 using chip-on-board technology. That is, a plurality of LED chips are disposed in a matrix on a front surface of the substrate 9. A coating material is applied to surfaces of the LED chips. The substrate 9 is a substantially circular flat plate made of metal, for example, a material having good heat conductivity and excellent in heat radiation property such as aluminum. When the substrate 9 is made of an insulating material, a ceramic material or a synthetic resin material having relatively good heat radiation property and excellent in durability can be applied. In the case where the synthetic resin material is used, glass epoxy resin or the like may be employed, for example.

The substrate 9 is mounted on the heat radiating member 2*c* formed on the bottom wall of the first reflector 2 in close surface contact therewith. To mount the substrate 9, an adhesive may be used. When the adhesive is used, a material having good heat conductivity obtained by mixing a metal oxide or the like into a silicone resin adhesive is preferably used. The substrate 9 and the heat radiating member 2*c* may not be in full surface contact, but may be in partial surface contact with each other.

The second reflector 3*a* made of white polycarbonate, ASA resin or the like is mounted on the front surface of the substrate 9. The second reflector 3*a* enables effective light emission by controlling distribution of light emitted from each of the LED chips. The second reflector 3*a* has a circular disc shape. A plurality of incident openings 3*b* are defined by a ridge line to be formed in the second reflector 3*a*. Each of the incident openings 3*b* of the second reflector 3*a* is disposed so as to face each of the LED chips of the substrate 9. That is, a substantially bowl-shaped reflecting surface 3*c* flaring from each of the incident openings 3*b* in an emission direction, that is, toward the ridge line is formed in the second reflector 3*a* with respect to each of the incident openings 3*b*. Three cutouts 3*d* to which screws are inserted and engaged are formed in an outer peripheral portion of the second reflector 3*a* with an interval of about 120 degrees therebetween.

The heat-conductive cover 5 is made of aluminum die casting. White acrylic baking paint is applied thereon. The heat-conductive cover 5 is formed in a substantially cylindrical shape tapered to a distal end continuously from the outer peripheral surface of the first reflector 2. The length and thickness of the cover 5 may be appropriately determined in consideration of the heat radiation effect or the like. A connection portion 5*a* of the cover 5 with the first reflector 2 has a ring shape with a predetermined width (see FIG. 2). Thus, the connection portion 2*d* of the first reflector 2 is formed so as to face the connection portion 5*a*. The connection portions 2*d* and 5*a* are thermally connected to each other in a surface contact state. A ring-shaped groove is formed in the connection portion 5*a*. An O-ring 10 made of synthetic rubber or the like is fitted into the groove. Three threaded holes 11 are formed on an inner side of the O-ring 10 with an interval of about 120 degrees therebetween.

The insulating cover 6 molded from PBT resin is provided along the shape of the heat-conductive cover 5 on an inner side of the heat-conductive cover 5. The insulating cover 6 is connected to the heat-conductive cover 5 on one end side so as to project from the heat-conductive cover 5 on the other end side. The base 7 is fixed to a projecting portion 6*a*. The base 7 is a standard E26 base. The base 7 is screwed into a lamp socket of a lighting equipment when the light emitting element lamp 1 is mounted in the lighting equipment. An air outlet 6*b* is formed in the projecting portion 6*a*. The air outlet 6*b* is a small hole for reducing a pressure when an internal pressure in the insulating cover 6 is increased.

A lighting circuit 12 is housed in the insulating cover 6. The lighting circuit 12 is used for controlling the lighting of the LED chips, and includes components such as a capacitor and a transistor as a switching element. The lighting circuit 12 is mounted on a circuit board. The circuit board has a substantially T-shape and is housed longitudinally in the insulating cover 6. A narrow space can be thereby effectively utilized for mounting the circuit board therein. A lead wire 12*a* extends from the lighting circuit 12 to be electrically connected to the substrate 9 of the light source portion 3 through a lead wire insertion hole 12*b* formed in the heat radiating member 2*c*. The lighting circuit 12 is also electrically connected to the base 7. The lighting circuit 12 may be entirely housed within the insulating cover 6 or may be partially housed within the insulating cover 6 with a remaining portion being housed within the base 7.

A filling material 13 fills the insulating cover 6 so as to cover the lighting circuit 12. The filling material 13 is made of silicone resin and has elasticity, insulating property and heat conductivity. To fill the insulating cover 6, a liquid filling material 13 is first injected from above the insulating cover 6. The filling material 13 is injected to reach the level at a top end portion of the insulating cover 6. The filling material 13 is then hardened and stabilized in a high temperature atmosphere.

The front lens 8 is attached to the first reflector 2 via a silicone resin packing or seal so as to hermetically cover the emission opening portion 2*b* of the first reflector 2. A collecting lens or a diffusing lens may be appropriately selected according to the intended use as the front lens 8.

The heat-conductive first reflector 2 and the heat-conductive cover 5 will be connected in the following manner.

The connection portion 2*d* of the first reflector 2 is disposed so as to face the connection portion 5*a* of the heat-conductive cover 5. The substrate 9 is arranged on the heat radiating member 2*c* of the first reflector 2, and the second reflector 3*a* is overlapped thereon. Subsequently, screws 14 are screwed into the threaded holes 11 of the heat-conductive cover 5 through the cutouts 3*d* of the second reflector 3*a* and the threaded through holes of the first reflector 2. The heat-conductive first reflector 2 is thereby fixed to the heat-conductive cover 5. Then, a bottom end of the second reflector 3*a* presses the front surface of the substrate 9, so that the second reflector 3*a* and the substrate 9 are fixed to the bottom wall of the first reflector 2. In such a state, the O-ring 10 is elastically deformed between the connection portion 5*a* and the connection portion 2*d* to thereby connect the connection portions 5*a* and 2*d* in an airtight state. That is, the inner side of the O-ring 10 is maintained in an airtight state.

The wiring for electrical connection between the lighting circuit 12 and the substrate 9 on which the LED chips are mounted by the lead wire 12*a* is done on the inner side of the O-ring 10.

An operation of the light emitting element lamp 1 having the structure and configuration mentioned hereinabove will be described hereunder.

When the light emitting element lamp 1 is electrified by mounting the base 7 in a socket of a lighting apparatus, the lighting circuit 12 is activated to supply power to the substrate 9. The LED chips thereby emit light. Distribution of the light emitted from each of the LED chips is controlled by each of the reflecting surfaces 3*c* of the second reflector 3*a*. The light is also reflected by the first reflector 2, and passes through the front lens 8 to be projected frontward. Heat generated from the LED chips in association therewith is conducted to the heat radiating member 2*c* from a substantially entire rear surface of the substrate 9. The heat is further conducted to the first reflector 2 having a large heat radiation area. Furthermore, the heat is conducted to the connection portion 5*a* of the heat conductive cover 5 from the connection portion 2*d* of the first reflector 2, and is conducted to the entire heat conductive cover 5.

The respective members are thermally connected to each other as described above, so that a temperature rising of the substrate 9 can be suppressed by radiating the heat through the heat conducting path. Meanwhile, the heat generated from the lighting circuit 12 is conducted to the first reflector 2 via the filling material 13 and is radiated therefrom. The heat is then transferred to the base 7, which is then conducted to the lamp socket of the lighting equipment or the like, and is radiated therefrom.

Furthermore, in the light emitting element lamp 1 according to the present example, the front lens 8 is attached to the emission opening portion 2*b* of the first reflector 2 via the packing. The O-ring 10 is provided between the connection portion 2*d* of the first reflector 2 and the connection portion 5*a* of the heat-conductive cover 5. Additionally, the lighting circuit 12 is covered by the filling material 13. Accordingly, the electric insulating property is maintained, and a weather-resistance and rain-proof function is provided. The light emitting element lamp 1 is thereby appropriately used in outdoors. If the lighting circuit components function abnormally and the capacitor is damaged or blown, to increase the internal pressure in the insulating cover 6, a secondary damage may be caused because of employment of the sealed structure for the above purpose.

However, the increasing pressure inside the insulating cover 6 can be discharged through the air outlet 6*b*.

As described above, according to the present example, the temperature rising of the substrate 9 on which the light emitting elements 4 are mounted can be effectively suppressed by use of the heat conductive first reflector 2 and the heat-conductive cover 5. Since the first reflector 2 flares toward the emission opening portion 2*b*, the outer peripheral surface that produces a heat radiation effect has a large area, and the heat radiation effect is effectively improved. Since the heat-conductive first reflector 2 is in surface contact with the heat-conductive cover 5, good heat conductivity is achieved.

Furthermore, the light distribution can be controlled with respect to each of the LED chips by each of the reflecting surfaces 3*c* of the second reflector 3*a*, so that the desired optical processing could be performed. Moreover, since the O-ring 10 is provided between the connection portion 2*d* of the first reflector 2 and the connection portion 5*a* of the heat-conductive cover 5 to maintain the scalability, the waterproof function can be maintained and the power supply path to the light source portion 3 can also be ensured with the simple configuration. Additionally, since the components of the existing so-called beam lamp can be used, the components will be shared between the light emitting element lamp and the existing beam lamp. Accordingly, the light emitting element lamp can be provided at a low cost.

EXAMPLE 2

FIG. 11 shows a configuration in which the second reflector in the first example is not provided according to the present example. The same portions as those of the first example are assigned with the same reference numerals and duplicated description is omitted herein.

In this second example, the heat generated from the LED chips is also conducted to the heat radiating member 2*c* from substantially the entire rear surface of the substrate 9 and is further conducted to the first reflector 2 having a large heat radiation area in a manner similar to the first example, thus performing the effective heat radiation.

Figure 12:
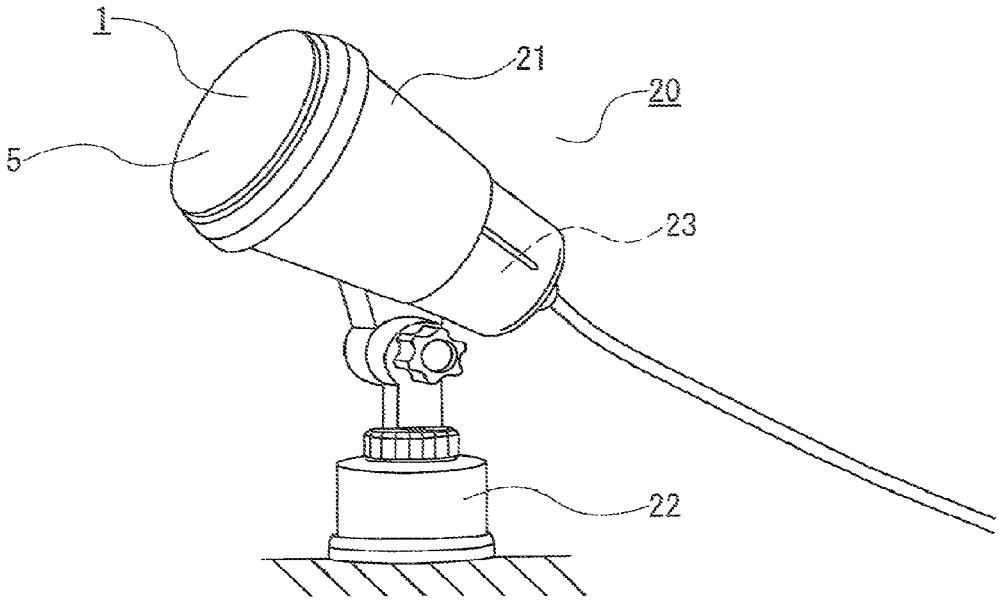
FIG. 12 is a perspective view illustrating an embodiment of a lighting equipment according to the present invention in which each of the light emitting element lamps of the above embodiments is applicable.

In the following, an embodiment of a lighting equipment or apparatus using the light emitting element lamp as a light source of the structures and characters mentioned above will be described with reference to FIG. 12.

A garden light is shown as a lighting equipment 20. The lighting equipment 20 includes an apparatus body 21 and a base 22 on which the apparatus body 21 is mounted. A socket 23 is provided in the apparatus body 21. The base 4 of the light emitting element lamp 1 is screwed into the socket 23. The lighting equipment or apparatus 20 is installed by fixing the base 22 to the ground or the like. The apparatus body 21 can be changed in direction relative to the base 22, so that a light emitting direction can be changed to any direction. By employing the lighting equipment 20 of the structure as described above, the lighting equipment capable of effectively suppressing the temperature rising of the substrate by use of the reflector can be provided.

Although the above-mentioned respective embodiments are described on the assumption that the components of the existing beam lamp are applied, the components of the existing beam lamp may not be necessarily used in the present invention.

INDUSTRIAL APPLICABILITY

According to the present invention, the heat generated from the substrate by lighting the light emitting element can be effectively radiated by using the relatively large outer peripheral surface of the reflector having the flaring shape toward the emission opening portion. Accordingly, the temperature rising of the light emitting element lamp can be effectively suppressed.

What is claimed is:

1. A light emitting element lamp comprising:

a heat conductor having an opening portion at one end side and an opening portion at another end side, and having inner and outer surfaces that widen toward the opening portion at the one end side, and a heat radiating member disposed between the one end side opening portion and the other end side opening portion so as to separate the openings from each other in a separation direction, wherein the heat conductor includes a recessed portion formed at a portion between the one end side and the other end side of the heat conductor, and the heat radiating member is provided with a flange portion in surface-contact with and extending along an inner surface of the heat conductor so as to form a surface continuous to the inner surface of the heat conductor, wherein a peripheral surface of the heat conductor is exposed to an exterior of the lamp;

a cover portion having a surface attached to the heat conductor;

a substrate provided with a light emitting element, wherein a surface of the substrate is thermally connected to an inside surface of the heat radiating member and wherein the light emitting element in the lamp is disposed on the substrate;

a lighting circuit housed in a space formed in the recessed portion of the heat conductor so as to be separated from the heat radiating member, wherein the lighting circuit is configured to light the light emitting element;

an insulating member disposed around the lighting circuit; and a base provided to another end side portion of the heat conductor protruding from the recessed portion.

2. The light emitting element lamp of claim 1, wherein the surface of the substrate directly and thermally contacts the inside surface of the heat radiating member.

3. The light emitting element lamp of claim 1, wherein the inside surface of the heat radiating member contacts the heat conductor in a surface contact state.

4. The light emitting element lamp according to claim 1, wherein a circuit board of the lighting circuit is disposed in parallel to a longitudinal axis of the lamp in the recessed portion.

5. The light emitting element lamp according to claim 1, wherein the lighting circuit is housed in a space defined by a base, the cover, and the recessed portion.

6. The light emitting element lamp according to claim 1, further comprising a reflecting surface extending from the other end side of the heat conductor toward the one end side opening portion of an inside of the heat conductor.

7. The light emitting element lamp according to claim 1, wherein the flange portion is configured to extend and widen toward the one end side.

8. The light emitting element lamp according to claim 1, wherein an insulating member is provided around the lighting circuit.

9. The light emitting element lamp according to claim 1, wherein an outer surface of the flange portion of the heat radiating member is bonded to an inner surface of the heat conductor with an adhesive.

10. The light emitting element lamp according to claim 1, wherein the other end side opening portion is spaced apart from the flange of the heat radiating member in the separation direction.

11. The light emitting element lamp according to claim 10, wherein the other end side opening extends from one inner surface of the heat conductor to another inner surface of the heat conductor, in a direction perpendicular to the separation direction, the one inner surface and the other inner surface being opposite to each another in the direction perpendicular to the separation direction.

12. A lighting equipment comprising:

an equipment body provided with a socket; and a light emitting element lamp configured to be mounted to the socket of the equipment body, the light emitting element lamp comprising:

a heat conductor having an opening portion at one end side and an opening portion at another end side, and having inner and outer surfaces that are widened toward the opening portion at the one end side, and the heat conductor further comprising a heat radiating member disposed between the one end side opening portion and the other end side opening portion so as to separate the opening portions from each other, the heat conductor further having a recessed portion formed at a portion between the one end side and the other end side of the heat conductor, and the heat radiating member is provided with a flange portion in surface-contact with and extending along an inner surface of the heat conductor so as to form a surface continuous to the inner surface of the heat conductor, wherein a peripheral surface of the heat conductor is exposed to an exterior of the lamp;

a cover portion having one end side attached to the heat conductor;

a substrate provided with a plurality of light emitting elements, wherein a surface of the substrate is thermally connected to an inside surface of the heat radiating member, wherein the light emitting element in the lamp is disposed on the substrate;

a lighting circuit housed in a space formed in the recessed portion of the heat conductor so as to be separated from the heat radiating member, wherein the lighting circuit is configured to light the light emitting element;

an insulating member disposed around the lighting circuit; and a base provided to another end side portion of the heat conductor protruding from the recessed portion.

13. The lighting equipment of claim 12, wherein the surface of the substrate is indirectly and thermally connected to the inside surface of the heat radiating member.

14. The lighting equipment according to claim 12, wherein the flange portion is configured to extend and widen toward the one end side.

15. The lighting equipment according to claim 12, wherein an insulating member is provided around the lighting circuit.

16. The lighting equipment according to claim 12, wherein an outer surface of the flange portion of the heat radiating member is bonded to an inner surface of the heat conductor with an adhesive.

* * * * *